United States Patent [19]

Blumstock et al.

[11] Patent Number: 5,004,106

[45] Date of Patent: Apr. 2, 1991

[54] MULTI-COMPARTMENT CONTAINER

[75] Inventors: Judith E. Blumstock; Leslie P. Morgan, both of New York, N.Y.

[73] Assignee: Protection Protection, Inc., New York, N.Y.

[21] Appl. No.: 480,115

[22] Filed: Feb. 14, 1990

[51] Int. Cl.[5] ..... B65D 69/00

[52] U.S. Cl. ..... 206/581; 206/823; 220/524; 220/525; 220/554

[58] Field of Search ..... 206/37, 38, 538, 533, 206/540, 581, 823; 220/20, 21, 22, 23.8, 23.83, DIG. 26, 337, 339; D9/341, 347, 348, 420, 421, 423

[56] References Cited

U.S. PATENT DOCUMENTS

| | | | |
|---|---|---|---|
| D141,079 | 5/1945 | Begoff | 220/DIG. 26 |
| 174,222 | 2/1876 | Foster | 220/22 |
| 392,942 | 11/1888 | Anger | 220/22 |
| 638,126 | 11/1899 | Kampfe | 220/22 |
| 687,664 | 11/1901 | Smith | 220/22 |
| 1,354,211 | 9/1920 | Reed | 206/38 |
| 1,618,366 | 2/1927 | Culling | 220/20 |
| 1,661,728 | 3/1928 | Rue | 220/20 |
| 1,817,310 | 8/1931 | Hauch | 220/DIG. 26 |
| 1,948,086 | 2/1934 | Wolfson | 220/DIG. 26 |
| 2,014,696 | 9/1935 | Pitman et al. | 220/DIG. 26 |
| 2,102,414 | 12/1937 | Hannings | 220/22 |
| 2,375,645 | 5/1945 | Gordon | 220/337 |
| 2,442,541 | 6/1948 | Fox | 220/DIG. 26 |
| 2,739,697 | 3/1956 | Kuddes | 220/DIG. 26 |
| 3,061,136 | 10/1962 | Sterngart | 220/20 |
| 3,258,017 | 6/1966 | Albert | 220/20 |
| 3,592,201 | 7/1971 | Haddaway | 220/DIG. 26 |
| 3,732,973 | 5/1973 | Crawford | 206/581 |
| 3,823,817 | 7/1974 | Hughes | 220/20 |
| 3,909,092 | 9/1975 | Kierman | 220/239 |
| 3,977,744 | 8/1976 | DeWitt | 220/20 |
| 4,163,496 | 8/1979 | Dogliotti | 210/339 |
| 4,538,725 | 9/1985 | Glover et al. | 206/37 |

*Primary Examiner*—David T. Fidei

*Attorney, Agent, or Firm*—Rosen, Dainow and Jacobs

[57] ABSTRACT

A multi-compartment container is disclosed herein for storing and transporting personal feminine products. The container comprises a plurality of compact multiple sized compartments extending over and under one another. The compartments each have a respective cover member that only reveals the contents of one particular compartment. The container is designed with rounded edges both inside and outside the compartments to protect the contents and the container.

9 Claims, 2 Drawing Sheets

FIG. 1
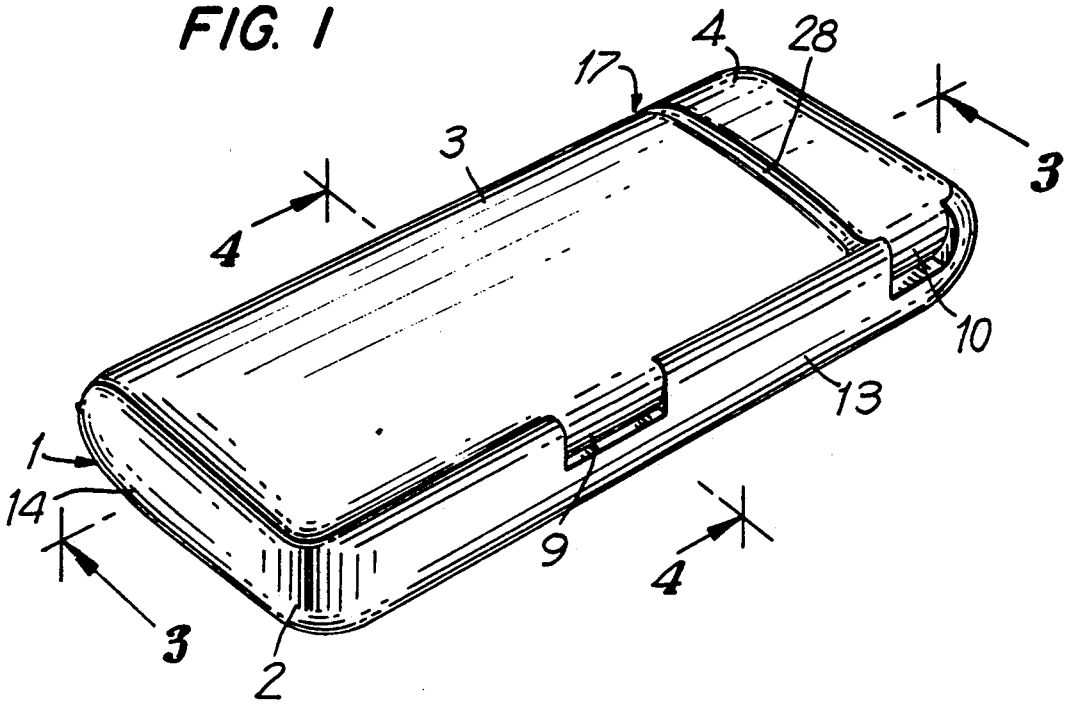
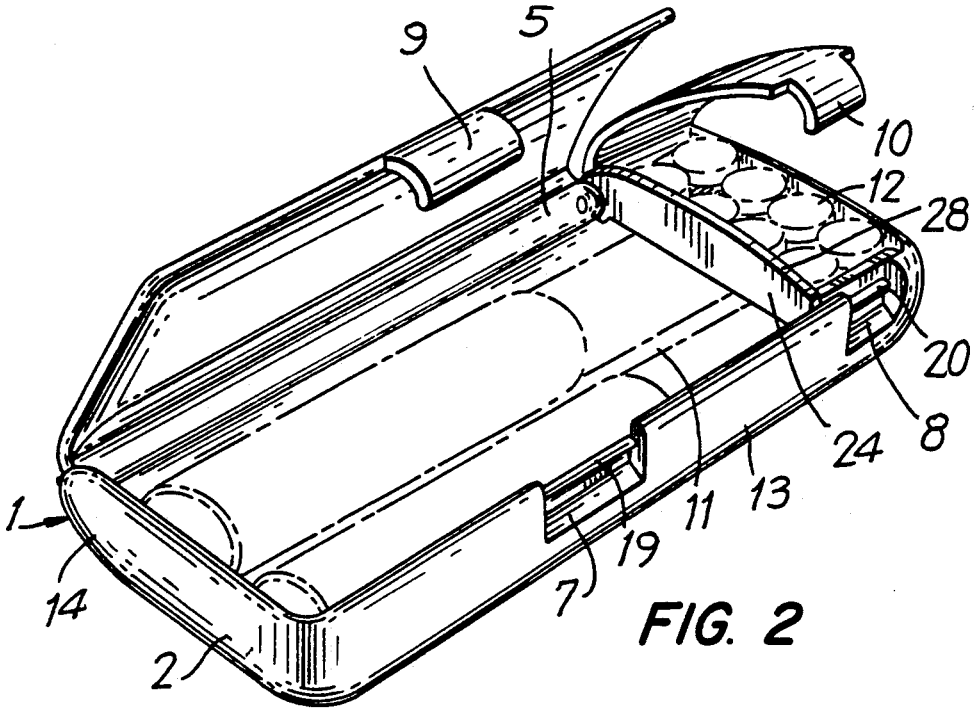
FIG. 2

FIG. 3
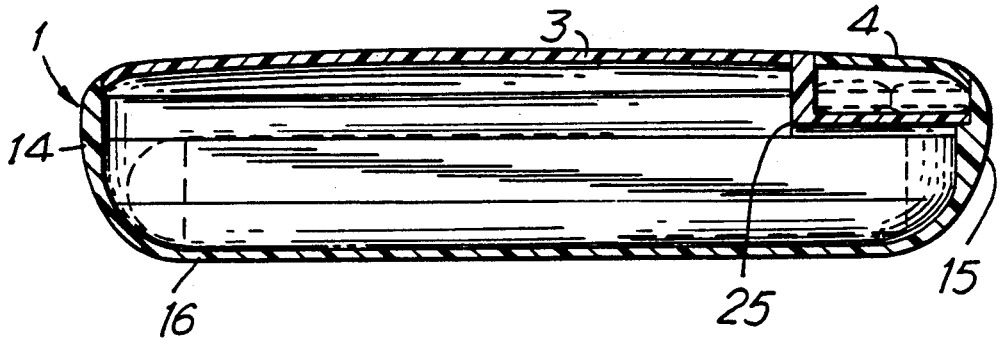
FIG. 4
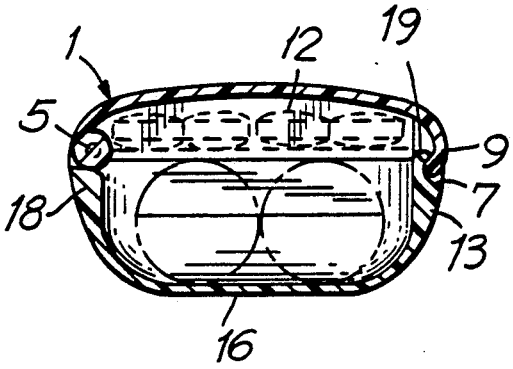
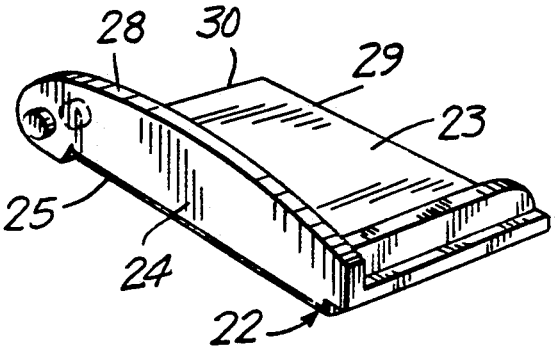
FIG. 5

MULTI-COMPARTMENT CONTAINER

FIELD OF THE INVENTION

The invention relates to multi-compartment containers with a plurality of storage compartments for pharmaceutical and personal products. The unit is designed to conveniently and discreetly store personal items in a compact sized case.

BACKGROUND OF THE INVENTION

Women today spend more time outside the home then they ever have in the past. Careers, children, social activities, part-time jobs and other interests keep women outside the home a majority of the time. Since women spend most of their time outside their home they need to be able to conveniently and discreetly carry any and all of their personal feminine necessities, especially such items needed for their menstrual cycle. Women menstruate for approximately one week out of every month. Thus, they need to have, at their disposal, items needed during menstruation.

Tampons, pills, and feminine napkins are the most popularly used items during menstruation. Given that they are likely to be out of the home, when women need to carry pills, such as MIDOL ® or any other standard menstrual cycle pill either prescription or over-the-counter, they need to carry the dispenser that the pills come in when they were purchased. These dispensers carry anywhere from 15–100 pills. They are awkward and noisy. Such pill dispensers are made to be kept in a medicine cabinet and not to be carried around constantly in the bottom of a women's purse or briefcase Tumbling around in a bottom of a purse, the pills usually end up chipping or breaking into pieces. Even worse, the dispensers themselves break or open, thus, spilling and contaminating the pills. Even if the dispensers do not break or spill open, it is still awkward and noisy to carry pills in such dispensers. There is nothing discreet about pills hammering against the sides of a pill dispenser constantly.

There are smaller sized containers available to hold a smaller number of pills. These containers are made of aluminum or tin rectangular pieces and house approximately 8–12 pills. The containers are supplied by the manufacturers of the particular pills and include the manufacturers' logo on them. Such containers are very small, only of the size to house the pills themselves, and are easily lost in the bottom of a woman's purse. Furthermore, they do not have secure sealing mechanisms. The sealing mechanisms usually consists of pressure points on the top back corners for flipping open the top front. This awkward sealing mechanism is neither secure nor convenient. It is either very difficult to open such containers or the containers open too quickly and the contents are spilt.

Moreover, women today are forced to carry around tampons because most of the public restrooms lack facilities to provide such items. To carry around tampons for use during the day, women have to carry them in their purse or briefcase. Purses or briefcases generally do not have separate compartments sized to carry around tampons. In a purse or briefcase, the tampons are not well concealed. They are revealed whenever the purse or briefcase is opened. This can often be a very embarrassing situation for women at work or at public places.

Furthermore, since the tampons are usually only protected by a flimsy covering of tissue or thin plastic, they do not last long in the bottom of a cluttered purse. Most purses are filled with all types of objects. The covers usually rip off the tampons before they ever get to be used. This is bad both financially and hygienically. If a ripped cover goes undetected, an unsuspecting user could contract any number of possible diseases or infections.

Another alternative is to carry the tampons around separately and in poorly designed cases, meant for usually anything but tampons. Some tampon manufacturers do provide a casing for carrying tampons in a purse or briefcase but they are not suitable casings. They are not discreet. They are shaped like tampons and some even have the tampon manufacturer's logo on them. Moreover, the containers provided by the manufacturers open and close with a friction fit. The friction fit is not suitable for staying closed in a cluttered purse or briefcase. Therefore, the containers usually open and spill the contents.

Moreover, there have been no structure provided that has separate compartments for both pills and tampons. The prior art includes multi-compartment containers that have multiple compartments contained in one structure. However, most of the compartments of a single container are of uniform size. The containers can only be used for storing items of equal size. In fact, most of the prior art devices are dedicated pill dispensers.

U.S. Pat. No. 4,793,492 (Halkich) is a home care pill box that contains a plurality of compartments for pills, arranged, indexed and differentiated in units for use over a selected period of time. In other words, the box has a line of seven compartments sized to hold pills. The box is attachable to an identical box also consisting of seven identical compartments.

U.S. Pat. No. 3,061,136 (Sterngart) discloses a container with a central horizontal partition with chambers for an upper and lower compartment of identical size. The same sized containers are attachable to form multiple compartments of the same size. These compartments are the identical size to store many small articles such as paper clips, stamps, sewing items, etc.

U.S. Pat. No. 4,817,808 (Bracy) discloses a receptacle for storing preparing food items. The disclosure includes eight compartments of the same size with individual lids for accessing the contents in such compartments. The invention also includes six separate compartments of different sizes but all were accessible only by a common cover opening. Thus, if the cover is opened the contents of all six compartments are revealed.

The prior art does not address the need for a multi-compartment container with multiple sized compartments with lids that do not reveal the contents of other compartments. Women today have a need to be able to discreetly, yet conveniently carry around items of a personal nature. A multi-compartment container that can hygienically and discreetly hold feminine products, as well as related medication, is needed in the market. So far, only pill dispensers and containers with the same size compartments or containers with various sized compartments but having common covers that reveal the contents of more than one compartment are available.

Thus, among the common disadvantages of the prior art is the lack of ability to store items of different sizes.

Moreover, there is no convenient and compact device to carry different sized personal and private items.

SUMMARY OF THE INVENTION

A principal object of the invention is to provide a container with multiple compartments of different sizes to effectively hold items of a personal feminine nature.

A further object of the invention is to provide a container with multiple compartments of different sizes wherein each compartment can only be accessed by a designated lid, thus allowing any contents in the rest of the compartments to remain unseen.

A further object of the invention is to provide a container having a plurality of compartments compactly designed with at least one compartment extending under another compartment.

A further object of the invention is to provide a container designed to be carried conveniently and discreetly in a women's purse or briefcase without damaging any of the contents of such container.

A further object of the invention is to provide a container that is sanitary and secure to hold feminine personal items.

These and other objects are achieved briefly speaking by the present novel invention which comprises a container having different sized compartments and respective cover members, particularly, a multi-compartment container comprising a body member made of one piece or unit of molded plastic shaped to form an elongated box-like shape having a flat bottom side and four upwardly disposed sides thereon; a partition attached inside at least one of the sides of the body member separating the body member into a first and second compartment, with the first compartment being larger than the second compartment and extending under the second compartment; a top member attached to the body member having first and second cover members, with the first cover member being larger than the second cover member and permitting access to the first compartment and the smaller second cover member permitting access to the second compartment.

One feature of the present invention is at least two different sized compartments that are separate and private from the other. Each compartment has a respective cover member that when opened only reveals the contents of one of the compartments Thus, a user may discreetly access the contents of one of the compartments without revealing the contents of the other compartments.

Another feature of the present invention are the different sized compartments, one extending under the other. The compartments, although of different size, are compactly arranged to fit in a jacket pocket, briefcase, suitcase or a purse. The different sizes of compartments hold a variety of different sized personal items.

Another feature of the present invention are snap fit closing devices for the covers on the container so that the container is not easily or accidentally opened and the contents can remain sanitary and do not spill out.

In accordance with a preferred embodiment of the present invention the compartments of the container are separated by a partition that is attached to a side or bottom of the container. This structure allows a compartment to extend under or over another compartment and efficiently compact the size of the container.

Also in accordance with a preferred embodiment of the present invention is a rounded edge on the partition separating the compartments. The rounded edge avoids any snagging or tearing of the contents of the compartment that has the edge protruding into its interior The corners and edges on the exterior of the container are also rounded. The container is shaped to be symmetrically rounded so that it does not catch or snag any items in a purse or a jacket.

BRIEF DESCRIPTION OF THE DRAWINGS

The invention will now be described in detail with respect to several preferred embodiments with reference to the accompanying drawings, wherein;

FIG. 1 is a perspective view of one form of the container in accordance with the invention;

FIG. 2 is the perspective view of the form of the invention shown in FIG. 1 with covers opened;

FIG. 3 is a cross-sectional view along the line 3—3 of FIG. 1;

FIG. 4 is a cross-sectional view along the line 4—4 of FIG. 1;

FIG. 5 shows a partition part of the form of the invention shown in FIG. 1.

DETAILED DESCRIPTION OF THE PREFERRED EMBODIMENTS

FIG. 1 is a perspective view of one form of the multi-compartment container in accordance with the invention. The shown embodiment is an elongated box-like shaped plastic housing structure (container) 1 made by an injection molding process and having a bottom, four sides and two cover numbers. The shown container 1 is 5½ inches in length (across front and back sides), 2¼ inches wide, and 1¼ inches in height. The container 1 comprises a bottom, lower member 2 (body member) having compartments 11, 12 and a top member 17 having covers 3, 4. The top member 17 shown in FIGS. 1 and 2 comprises of two covers 3, 4 separated by a top edge 28 of a partition side 22. The covers 3, 4 are connected to a back length side 18 of the bottom member 2 with a conventional hinge mechanism 5.

The body member 2, having a flat, horizontal bottom side 16 and four upwardly disposed sides 13, 14, 15, 18, is made from one piece of molded plastic. A flat piece of plastic is molded to form all five exterior sides: a flat bottom side 16 and four upwardly disposed sides 13, 14, 15, 18. The flat bottom side 16 is rounded up on four corners to form the four upwardly disposed sides 13, 14, 15, 18. The intersections (corners) of the sides are not perfectly perpendicular in any direction but are symmetrical and rounded and shape. The upwardly disposed sides are slightly angled away from the perpendicular of the bottom side 16. The front side 13, back side 18 and two end sides 14, 15 are the upwardly disposed sides of the container, and are rounded from the bottom side's horizontal, approximately 75 degrees. Thus, the flat bottom side 16 bends and rounds at four corners to form sides with approximately 75 degree angles from an outside horizontal and 105 degrees from the bottom 16 of the inside of the housing. The bottom side 16 is rounded up 1¼ inches from each edge to form rounded corners and sides of the housing structure. The rounded corners allow the container to smoothly fit into pockets, jackets, briefcases, suitcases, and purses without tearing or snagging because of the rounded ends and minimum number of discrete pieces and edges.

The container shown in FIG. 1 has two covers 3, 4 that can be opened and snapped shut. A first larger cover 3 is 4 3/16 inches long (along the front 13 and the back 18 side) and 2⅛ inches wide (along the left end side 14 and the partition edge 28). A second smaller cover 4 is 15/16 inch long (along the front 13 and the back 18 side) and 2⅛ inches wide (along the partition 28 and the right end side 15). Both ends of each cover are rounded to fit symmetrically on the sides of the bottom member 2 of the housing structure. On a front length side of each of the cover members there is an extension piece 9, 10 that is used to snap onto the body member 2. Each back length side, opposite the side with the extension piece, is connected with a hinge 5 to the body member in a conventional manner.

FIG. 2 shows the covers 3, 4 open. Each cover opens into its own respective compartment. Neither compartment is revealed by opening any cover other than its own. Thus, a first large compartment 11 is revealed when the first larger cover member 3 is opened. The first large compartment 11 extends underneath a second compartment 12 revealed only by a second smaller cover 4. The first large compartment effectively extends the length and width of the structure. A right upper end of the first larger compartment is sectioned off being the separate second smaller compartment 12. The second smaller compartment 12 is revealed by opening the second smaller cover member 4. The second smaller compartment 12 is 15/16 inch in length 2⅛ inches in width (along the partition 22 and right end side 15) and approximately ¼ inch in height. The second smaller compartment 12 is protruding or carved out of an upper right portion of the first larger compartment 11. Stated differently, the second compartment sits above the bottom and within an upper right portion of the first larger compartment.

The covers 3, 4 have means for securing to the front length side 13 of the body member 2. The covers 3, 4 are closed by snapping the extension pieces 9, 10 onto respective recesses 7, 8 on the front length side 13 of the body member 2. The extension pieces 9, 10 are centered on a front length side of the cover members 3, 4. The extension pieces 9, 10 are disposed downward to snap onto the body member 2 at the respective recess areas. The recesses 7, 8 are located on the top edge 21 of the front side 13 and are positioned to accept their respective extension pieces 9, 10. Each recess has a raised lip portion 19, 20 that the extension piece snaps over for a secure snap fit. The raised lip portions 19, 20 are for receiving the extension pieces 9, 10 and securely holding the extension pieces 9, 10 in place. Neither cover can be opened without forcing the respective extension piece over the respective raised lip portion. To lift the covers 3, 4 the extension pieces must be forcefully pushed over their respective raised lip portion, then lifted in an up position. The hinge 5 on the back side 18 of the cover members is tight enough to hold the covers up in any up position A partition 22 separates the two compartments of the containers. An edge 28 of the partition 22 also separates the two cover members 3, 4. FIG. 3 shows the partition to be of a continuous sheet of material bent and rounded at a 90 degree angle to form both a bottom 23 and a side 24. The bottom 23 and side of the partition are connected together to form a backward L-shaped structure with a rounded edge side 25. The rounded edge side 25 protrudes into the first compartment 11.

FIG. 2 shows the side 24 of the partition 22 extending from the front length side 13 of the body member to the back length side 18. The side of the partition 24 is located 1 1/16 inches left and parallel to the right side 15 of the body member. The side of the partition is approximately ⅛ inch thick and extends approximately ¼ inch into the inside of the body member from and perpendicular to the top 17.

FIG. 5 shows the partition 22 apart from the housing structure to depict its features. The top edge 28 of the side of the partition 24 is rounded up to symmetrically match the housing structure while the bottom edge side 25 of the side 24 is rounded to the left and connects the side 24 to the bottom 23. The rounded top edge 28 of the partition separates the cover members 3, 4 along the top 17 of the housing structure when the container housing is closed. When the cover members 3, 4 are opened, the partition 22 remains attached to the body member 2 of the housing. A back portion of the side 24 of the partition is molded onto the same hinge mechanism 5 that attaches the two cover members 3, 4.

The bottom of the partition 23 is located ¼ inch under and parallel to the top member 17. A back edge 30 of the bottom of the partition is molded to the inside of the back length side 18 of the housing. A right edge 29 of the bottom 23 of the partition is molded onto the inside of the right side end 15 of the body member, approximately ¼ inch from the top edge 26 of the right side end 15. The left edge side 25 of the partition (connecting the bottom 23 and side 24) is rounded up and forms the side of the partition 24. The bottom of the partition is 1/16 inch thick, which is also 1/16 inch thinner than the side of the partition 24.

A modification in accordance with the invention comprises adding more compartments to the container. In this variation, a third compartment is attached to the outside of the flat bottom side 16 of the body member For example, a thin compartment with a length and width equal of that of the container, is added underneath the first larger compartment. A cover to access such a compartment is hinged to the same hinge mechanism as the other covers. Since the invention is mainly for sanitary products, the second small compartment can store pills, the first large compartment extending under the second small compartment can store tampons and the thinner large compartment can store mini-pads or any other item including but not limited to Q-tips ®, jewelry, etc.

Another modification in accordance with the invention, comprises changing the structure of the covers. The two exterior covers are replaced by one exterior cover and one interior cover. The exterior cover accesses the first larger compartment and the interior cover. The interior cover still accesses the second smaller compartment. This modification would allow more privacy and security by completely concealing the presence of the second compartment.

A further modification in accordance with the invention comprises adding a compartment to the top member. In this example, a separate thin pocket compartment is attached on the inside surface of the first large cover. This pocket compartment could hold mini-pads or any other item.

Another modification in accordance with the invention comprises adding a compartment similar to the second smaller compartment so that the invention consists of three separate compartments, each accessed via its own lid. The two smaller compartments sit above the larger compartment which runs the length of the invention. Stated differently the two smaller compartments are disposed within a portion of the larger first compartment. The third compartment can either be next to or on the opposite side of the other smaller compartment.

The third compartment could be used to store any other small items, such as vitamin pills, other medication, jewelry, etc.

Another modification in accordance with the invention comprises a smaller version of the invention intended to hold two or fewer tampons. The larger compartment is reduced to approximately half size.

A further modification in accordance with the invention comprises a larger version of the invention intended to hold five or more tampons. The larger compartment is thus increased proportionately in size to facilitate more tampons A further modification in accordance with the invention comprises making the entire housing structure round without any distinct sides. In this example, the entire outside of the container is extruded as a round shaped hollow structure. A top portion is cut and hinged to form cover members. The container is completely rounded without any defined sides.

The invention could be fabricated of wood, cardboard, or other known materials. Wherein the above description the term plastic is used, it should be interpreted broadly to include, but not limited to, any various complex organic compounds produced by polymerization. Materials that can be molded, extruded, or cast into various shapes and films, or drawn into filaments used as textile fibers. Various types include: methacrylic acid polymer, methylmethacrylate polymer, polycarbonate and polystyrene. Any other like materials can be substituted by one skilled in the art.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. A multi-compartment container comprising:

(a) a body member made of one piece of molded plastic shaped to form an elongated box-like shape having a flat bottom side and four upwardly disposed sides thereon wherein said four sides and said bottom form a first compartment;

(b) a partition attached inside to at least one of said sides of said body member forming a second compartment nested within the first compartment, said partition providing a side and bottom for the second compartment wherein the bottom of the second compartment defines a space between the bottom of the second compartment and the bottom of the first compartment so that the first compartment being larger than said second compartment extends under said second compartment when the container is in a normal position whereby an elongated article can extend substantially along the bottom of the first compartment;

(c) first and second cover members attached to said body member, said first cover member being larger than said second cover member and permitting access to said first compartment and said smaller second cover member permitting access to said second compartment.

2. Container of claim 1 wherein said cover members are attached along a back length side of said body member by hinging means.

3. Container of claim 2 wherein said container includes a means for securing said cover members onto a front length side of said body member.

4. Container of claim 3 wherein said means for securing said cover members onto a front length side of said body member include extension pieces on said cover members permitting a snap fit of said cover members to said body member and recesses on a front length side of said body member with raised lip pieces on said recesses for receiving said extension pieces.

5. Container of claim 1 for holding personal products wherein said partition includes a rounded edge side protruding into said first compartment.

6. Container of claim 1 having a completely rounded shape including rounded sides and rounded cover members that fit symmetrically onto a rounded body member.

7. A multi-compartment container comprising:

(a) a body member made of one sheet of molded plastic shaped to form an elongated box-like shape having a flat bottom side and four upwardly disposed sides thereon wherein said four sides and said bottom form a first compartment;

(b) a partition attached inside to at least one of said sides of said body member forming a second compartment nested within the first compartment wherein said second compartment has a rounded edge protruding into said first compartment, said first compartment being larger than said second compartment extends under said second compartment when the container is in a normal position whereby an elongated article can extend substantially along the bottom of the first compartment;

(c) first and second cover members attached by a hinging means to said body member along a back length side of said body member, said first cover member being larger than said second cover member and permitting access to said first compartment and said smaller second cover member permitting access to said second compartment and said container comprises a means for securing said cover members onto a front length side of said body member.

8. Container of claim 7 wherein said means for securing said cover members onto a front length side of said body member include extension pieces on said cover members permitting a snap fit of said cover members to said body member and recesses on a front length side of said body member with raised lip pieces on said recesses for receiving said extension pieces.

9. Container of claim 7 having a completely rounded shape including rounded sides and rounded cover members that fit symmetrically onto a rounded body member.

* * * * *